United States Patent [19]

Williams et al.

[11] 4,299,898

[45] Nov. 10, 1981

[54] POSITIVELY CHARGED TONERS CONTAINING QUATERNARY AMMONIUM SALTS ATTACHED TO ACRYLATE POLYMERS

[75] Inventors: Meurig W. Williams, Rochester; Christoper J. AuClair, Fairport, both of N.Y.

[73] Assignee: Xerox Corporation, Stamford, Conn.

[21] Appl. No.: 35,752

[22] Filed: May 3, 1979

[51] Int. Cl.[3] ..... G03G 9/10; G03G 9/14

[52] U.S. Cl. ..... 430/106; 430/107; 430/108; 430/109; 430/110; 430/126; 430/122; 430/904

[58] Field of Search ..... 430/109, 110, 114, 904, 430/903, 106, 107, 108; 260/923, DIG. 18

[56] References Cited

U.S. PATENT DOCUMENTS

| | | | |
|---|---|---|---|
| 2,297,691 | 10/1942 | Carlson | 430/107 |
| 2,659,670 | 11/1953 | Copley | 430/107 |
| 2,839,401 | 6/1958 | Gray et al. | 526/923 |
| 3,239,465 | 3/1966 | Rheinfrank | 430/109 |
| 3,411,912 | 11/1968 | Dykstra et al. | 526/923 |
| 3,425,836 | 2/1969 | Perry et al. | 526/923 |
| 3,888,678 | 6/1975 | Bailey et al. | 430/533 |

*Primary Examiner*—John D. Welsh
*Attorney, Agent, or Firm*—E. O. Palazzo

[57] ABSTRACT

Disclosed are toners comprised of a colorant or pigment in a resin of an acrylate polymer of the following typical formula:

I.

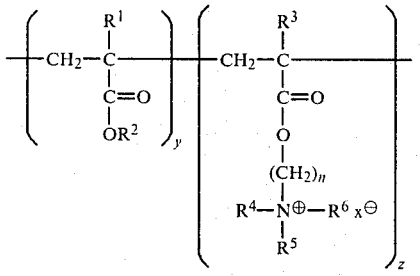

II.

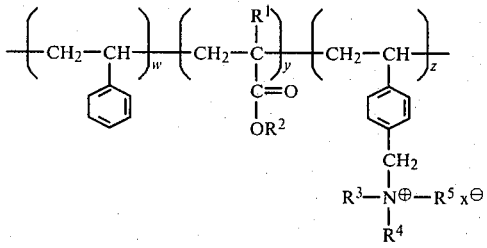

wherein $R^1$ and $R^3$ are independently selected from hydrogen, alkyl, or substituted alkyl radicals, $R^2$ is independently selected from alkyl, aryl, substituted alkyl, substituted aryl radicals and $R^4$, $R^5$ and $R^6$ are independently selected from hydrogen, alkyl, aryl, substituted alkyl, and substituted aryl; radicals x is an anion, n is a number of from 1 to about 20 and w, y and z are numbers of from 20 to about 1,400, or

III.

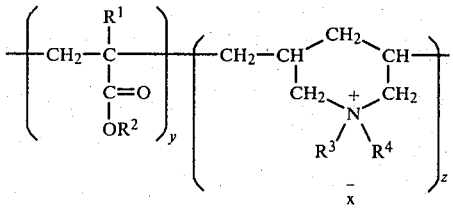

wherein $R^1$ is independently selected from hydrogen, alkyl or substituted alkyl radicals; $R^2$ is alkyl, aryl, substituted alkyl, or substituted aryl radicals; $R^3$, and $R^4$ are independently selected from hydrogen, alkyl, aryl, substituted alkyl or substituted aryl radicals, and y and z are numbers of from 20 to about 1,400.

9 Claims, No Drawings

POSITIVELY CHARGED TONERS CONTAINING QUATERNARY AMMONIUM SALTS ATTACHED TO ACRYLATE POLYMERS

This invention is generally directed to positively charged toners and developers containing such toners which are useful for developing images in an electrophotographic system. More specifically, the present invention is directed to toners and developers containing a quaternary ammonium salt attached to an acrylate polymer which causes the resulting toner resin to be charged positively.

The use of toners as part of a developer composition is well known such compositions being employed in the xerographic process for the purpose of developing electrostatic charge formed on the photoconductive insulating surface. Development methods include cascade development, U.S. Pat. No. 3,618,552, magnetic development, U.S. Pat. Nos. 2,874,063 and 3,251,706, powder cloud development, U.S. Pat. No. 2,221,776 and touchdown development, U.S. Pat. No. 3,166,432. Reversal developers as described in U.S. Pat. No. 2,986,521 have been used for the purpose of producing a reverse copy of the orginal. Thus, for example, it may be desirable to produce a negative copy from a positive original or a positive copy from a negative original, and this is effected by applying to the image a developer powder which is repelled by the charged areas of the image and adheres to the discharged areas. Toners possessing positive charges are found to be very useful in such a system and in particular, in electrophotographic environments employing organic photoreceptors which in some instances are initially charged negatively rather than positively, thus, requiring the need for a positively charged toner.

U.S. Pat. No. 4,079,014 discloses the use of diazo type compounds as charge control agents for electrostatic toner compositions while U.S. Pat. No. 3,893,935 contains a similar teaching with the exception that certain quaternary ammonium salts are used as the charge control agent. British Patent Publication No. 1,490,584 published Nov. 2, 1977, discloses the use of alkoxylated amines as charge control agents.

Many of the proir art positive developers mentioned have a tendency over a period of time to loose their positive charge and thus, the quality of images to be developed employing such developers is adversely effected. Additionally, these materials in some instances are incompatible with the thermoplastic resins. Thus, it is very difficult to uniformly disperse or dissolve such materials. This can cause particle to particle nonuniformity and wide distribution of electrical charges which reduces the quality of the image developed and shortens the developer life. Further, many of these additives separate from the toner and cause degradation of triboelectric properties and undesirable contamination of the photoreceptor.

SUMMARY OF THE INVENTION

It is an object of the present invention to provide a toner which charges positively and which retains such a charge over a long period of time.

It is another object of this invention to provide a developer which contains toner and carrier with the toner being charged positively.

An additional object of this invention is to provide toners which will develop electrostatic latent images containing negative charges on the photoreceptor, and which will allow the transfer of such images effectively from the photoreceptor to a substrate such as plain bond paper without causing blurring or adversely effecting the quality of the resulting image.

These and other objects of the present invention are accomplished by providing positively charged toners comprised of a colorant or pigment and a resin of an acrylate polymer selected from those of the following formula:

I.

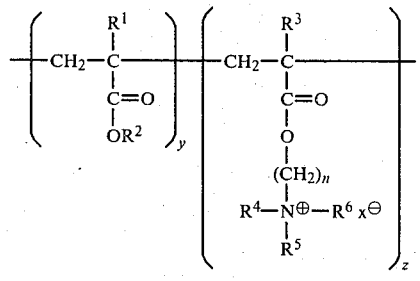

II.

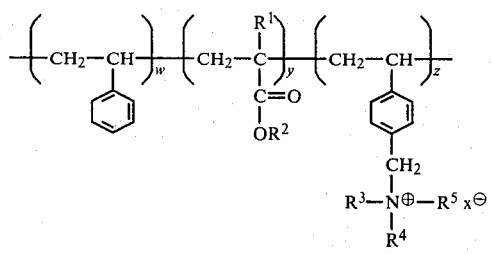

wherein $R^1$ and $R^3$ are independently selected from hydrogen, alkyl, or substituted alkyl radicals, $R^2$ is independently selected from alkyl, aryl, substituted alkyl, or substituted aryl radicals and $R^4$, $R^5$ and $R^6$ are independently selected from hydrogen, alkyl, aryl, substituted alkyl, or substituted aryl radicals; x is an anion such as halide, sulfate, nitrate, borate, sulfonate, or phosphate; n is a number of from 1 to about 20; y, z and w are numbers of from about 20 to about 1,400, or

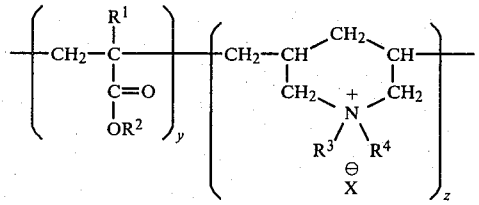

wherein $R^1$ is independently selected from hydrogen, alkyl or substituted alkyl radicals; $R^2$ is alkyl, aryl, substituted alkyl, or substituted aryl; radicals $R^3$ and $R^4$ are independently selected from hydrogen, alkyl, aryl, substituted alkyl or substituted aryl radicals, y, z and x are as defined herein. Attachment of the quaternary ammonium salt to the polymer chain eliminates separation of the salt thus resulting in nondegradation of the toners and a developer which maintains the proper triboelectric charges over a substantial period of time. The molecular weight of the acrylate polymer is from about 5,000 to about 400,000, although polymers having a molecular weight of less than 5,000 or more than 400,000 may be useful. Also embraced within the scope of this invention are developers comprised of a colorant or pigment, a carrier material and the acrylate polymer. Polyblends of acrylate toners with other resins as specified hereinafter are also within the scope of the present invention.

Examples of alkyl radicals include those containing from 1 to about 20 carbon atoms such as for example, methyl, ethyl, propyl, butyl, tertiary butyl, pentyl, heptyl, octyl, nonyl, decyl, cetyl, pentadecyl and the like while the halogen groups include chloride, bromide, fluoride and iodide. Aryl radicals include those containing from 6 to about 20 carbon atoms, such as phenyl, anthracyl, napthyl and the like. Both the alkyl and aromatic radicals can contain substituents such as alkyl and halogen as disclosed herein, as well as other substituents.

Illustrative examples of preferred acrylate polymers that are included within the scope of the present invention are: copolymers of n-butyl methacylate diallyldimethylammonium chloride, n-butyl methacrylate dimethylaminoethylmethacrylate hydrochloride, n-butylmethacrylate vinyl benzyl trimethyl ammonium chloride, terpolymers of styrene/n-butyl methacrylate/dimethylamino ethyl-methacrylate hydrochloride, styrene/n-butyl methacrylate vinylbenzyl trimethyl ammonium chloride, the corresponding bromide and sulfonate salts, methyl methacrylate n-butyl methacrylate, t-butyl aminomethyl methacrylate hydrochloride, styrene/n-butyl methacrylate, diallyldimethyl-ammonium chloride, the corresponding bromide, sulfonate, sulfate and phosphate salts.

The ammonium salt containing monomer may be employed in any amount that results in the toner that is charged positively in comparison to the carrier and that develops and electrostatically transfers well. For example, thus, the amount of ammonium salt monomer present can range from about 0.5 weight percent to about 20 weight percent, and preferably from 1 weight percent to about 5 weight percent of the total toner weight.

Several methods may be employed for producing the toner of the present invention including melt blending the resin and the pigment coated with the acrylate material followed by mechanical attrition. Other methods involve those known in the art such as spray drying, melt dispersion and dispersion polymerization. In the spray drying method, the appropriate acrylate polymer is dissolved in an organic solvent like dichloromethane, and a toner colorant added to the solvent. This solution is then sprayed through an atomizing nozzle using an inert gas such as nitrogen as the atomizing agent. The solvent evaporates during atomization, resulting in toner particles of a pigmented resin. Particle size of the resulting resin varies depending on the size of the nozzle, however, particles of a diameter between about 0.1 micrometers and about 100 micrometers generally are obtained.

Any suitable colorant, dye or pigment may be employed in preparing the toners of the present invention, such materials being well known and including the example, carbon black, nigrosine, indolines, aniline blue, calco oil blue, chrome yellow, ultramarine blue, DuPont oil red, methylene blue chloride, phthalocyanine blue and mixtures thereof. The pigment or dye should be present in the toner in sufficient quantity to render it highly colored so that it will form a clearly visible image on the recording member. For example, where conventional xerographic copies of documents are desired, the toner may comprise a black pigment such as carbon black or a black dye such as Amaplast black dye available from the National Aniline Products Incorporated. Preferably the pigment is employed in amounts from about 3% to about 20% by weight based on the total weight of toner, however, if the toner color employed is a dye, substantially smaller quantities of the color may be used.

Any suitable carrier material can be employed as long as such particles are capable of triboelectrically obtaining a charge of opposite polarity to that of toner particles. In the present invention thus the carrier would have a negative polarity, and the toner particles would be positively charged, in order that the toner particles will adhere to and surround the carrier particles. Thus, the carriers can be selected so that the toner particles acquire a charge of a positive polarity and include materials such as sodium chloride, ammonium chloride, ammonium potassium chloride, Rochelle salt, sodium nitrate, aluminum nitrate, potassium chlorate, granular zircon, granular silicon, methylmethacrylate, glass, steel, nickel, iron ferrites, silicon dioxide and the like. The carriers can be coated with for example fluoropolymers, can be partially coated, or may contain no coating. Many of the typical carriers that can be used are described in U.S. Pat. Nos. 2,618,441; 2,638,416; 2,618,522; 3,591,503; 3,533,835; and 3,526,533. Also nickel berry carriers as described in U.S. Pat. Nos. 3,847,604 and 3,767,598 can be employed, these carriers being nodular carrier beads of nickel characterized by surface of reoccurring recesses and protrusions providing particles with a relatively large external area. The diameter of the coated carrier particle is from about 50 to about 1000 microns, thus allowing the carrier to possess sufficient density and inertia to avoid adherence to the electrostatic images during the development process.

The carrier may be employed with the toner resin in any suitable combination, however, best results are obtained when about 1 part per toner is used and about 10 to about 200 parts by weight of carrier.

Toner compositions of the present invention may be used to develop electrostatic latent images on any suitable electrostatic surface capable of retaining charge including conventional inorganic photoconductors, however, the toners of the present invention are best utilized in systems wherein a negative charge resides on the photoreceptor and this usually occurs with organic photoreceptors, illustrative examples of such photoreceptors being polyvinyl carbazole 4-dimethylaminobenzylidene, benzhydrazide; 2-benzylidene-amino-carbazole, 4-dimethylamino-benzylidene, benzhydrazide; 2-benzylidene-amino-carbazole, polyvinyl carbazole; (2-nitro-benzylidene)-p-bromoaniline; 2,4-diphenylquinazoline; 1,2,4-triazine; 1,5-diphenyl-3-methyl pyrazoline 2-(4'-dimethyl-amino phenyl)-benzoxazole; 3-amino-carbazole; polyvinylcarbazole-tritrofluorenone charge transfer complex; phthalocyanines and mixtures thereof. Examples of inorganic photoreceptors include selenium, selenium alloys such as arsenic-selenium, sulfur-selenium and the like, as well as halogen doped selenium or selenium alloys.

In one embodiment of the present invention, polyblends of the acrylate polymer of the present invention can be mixed with other suitable resins including acrylates, polyesters, polyamides, epoxies, vinyl resins, polyurethanes and the like. Suitable vinyl resin that may be employed in the polybend toners include homopolymers or copolymers of two or more vinyl monomers.

Typical of such vinyl monomeric units include: styrene, p-chlorostyrene vinyl naphthalene, ethylenically unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alpha methylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof. The ratio of ammonium salt containing acrylate polymer to the second resin ranges from about 30 percent polymer to about 70 percent resin, to about 70 percent polymer and to about 30 percent resin, providing there is present at least 1 to about 5 percent of the monomer containing the ammonium salt.

The following examples are being supplied to further define the species of the present invention, it being noted that these examples are intended to illustrate and not limit the scope of the present invention. Parts and percentages are by weight unless otherwise indicated.

EXAMPLE I

As a control, there was prepared by melt blending followed by mechanical attrition a toner resin comprised of a copolymer 50/50 styrene n-butyl methacrylate, 10 percent by weight, and 10 percent of a Regal 330 carbon black, commercially available from Cabot Corporation. 3 parts of this toner and 97 parts of 0.35 percent perfluoroalkoxy fluoropolymer, commercially available from duPont Company, coated Hoeganaes steel carrier were placed in a glass jar and roll milled. The triboelectric charge was then measured, this charge being -2 uC/g (microcoulombs per gram). Such a toner would not be useful for developing images in an electrophotographic imaging system wherein the photoreceptor is charged negatively.

EXAMPLE II

There was prepared a toner comprised of 94 percent of a terpolymer of styrene, n-butyl methacrylate, dimethylaminoethylmethacrylate hydrochloride in the ratio of 47/50/3 weight percent with 6 percent of Regal 330 carbon black, commercially available from Cabot Corporation, by melt blending followed by mechanical attrition. Three parts of this toner and 97 parts of 0.35 of a perfluoroalkoxy fluoropolymer, commercially available from duPont Company, coated Hoeganaes steel carrier were placed in a glass jar and the triboelectric charge of this toner was measured as accomplished in Example I. The triboelectric charge on the toner was +30 microcoulombs per gram indicating that the toner charged positively against the carrier. This toner had excellent carbon black dispersion and good particle to particle uniformity, and when used as a developer in an electrophotographic device containing a polyvinyl carbazole photoreceptor charged negatively images of high quality and excellent resolution resulted.

EXAMPLE III

There was prepared by melt blending followed by mechanical attrition a toner comprised of 94 percent of a terpolymer of styrene, n-butyl methacrylate and diallyldimethylammonium chloride in the ratio of 47/50/3 weight percent with 6 percent of Regal 330 carbon black commercially available from Cabot Corporation. Three parts of the toner in 97 parts of 0.15 percent Kynar coated Hoeganaes steel carrier were placed in a glass jar and the triboelectric charge of the toner was measured as accomplished in Example I.

The triboelectric charge of the toner was +24 uC/g.

EXAMPLE IV

A toner was prepared comprised of a polyblend of 50 parts of polycaprolactone with 50 parts of a copolymer of n-butyl methacrylate and vinyl-N-methyl pyridinium chloride in the ratio 95/5 weight percent, with 6 parts of Regal 330 carbon black commercially available from Cabot Corporation. Three parts of the toner in 97 parts of 0.15 percent Kynar coated Hoeganaes steel carrier were placed in a glass jar and the triboelectric charge of the toner measured as accomplished in Example I. This toner had excellent carbon black dispersion, good particle to particle uniformity and when used as a developer in an electrophotographic device containing a polyvinyl carbazole photoreceptor charged negatively images of high quality and excellent resolution resulted.

EXAMPLE V

There was prepared in accordance with Example II a toner comprised of a terpolymer of styrene/n-butyl methacrylate/vinyl benzyl trimethylammonium chloride, in the ratio 40/58/2 weight percent, and when mixed with the carrier of Example II substantially similar results were obtained.

EXAMPLE VI

There was prepared a polyblend of styrene/n-butyl methacrylate copolymer 65/35, and n-butyl methacrylate, diallyldimethylammonium chloride copolymer (96/4 ratio of 50 to 50). This polyblend toner when mixed with carrier charged positively and produced images of high quality when used in an electrophotographic device containing a photoreceptor charged negatively.

EXAMPLE VII

There is prepared a toner comprised of 90 percent of a copolymer of n-butyl methacrylate diallyldimethylammonium chloride 60/40 weight percent, and 10 percent of Regal 330 carbon black commercially available from Cabot Corporation. Five parts of this toner and 95 parts of 0.15 percent Kynar coated Hoeganaes steel carrier were placed in a glass jar and the triboelectric charge of the toner was measured as accomplished in Example I and found to be +21 uc/g indicating it would be useful for the development of images in an electrophotographic system containing a photoreceptor charged negatively.

Other modifications of the present invention will occur to those skilled in the art based upon a reading of the present disclosure. These are intended to be included within the scope of this invention.

What is claimed is:

1. A dry developer composition comprised of 94 percent by weight of a terpolymer resin of styrene, n-butylmethacrylate, and dimethyl amino ethyl methacrylate hydrochloride, 6 percent by weight of carbon black, and a carrier material consisting of a steel core coated with a perfluoro-alkoxy fluoropolymer.

2. A dry developer composition in accordance with claim 1 wherein the styrene is present in an amount of 47 percent by weight, the n-butylmethacrylate is present in an amount of 50 percent by weight, and the dimethyl amino ethyl methacrylate hydrochloride is present in an amount of 3 percent by weight.

3. A dry developer composition comprised of a 94 percent by weight of a terpolymer of styrene, n-butylmethacrylate, and dially-dimethyl ammonium chloride, 6 percent by weight of carbon black, and a carrier material consisting of a steel core coated with a vinylidene fluoride resin.

4. A dry developer composition in accordance with claim 3 wherein the styrene is present in an amount of 47 percent by weight, the n-butylmethacrylate is present in an amount of 50 percent by weight, and the diallydimethyl ammonium chloride is present in an amount of 3 percent by weight.

5. A dry developer composition comprised of 94 percent by weight of a terpolymer of styrene, n-butylmethacrylate, and vinyl benzyl trimethylammonium chloride, 6 percent by weight of carbon black, and a carrier material consisting of a steel core coated with a perfluoro-alkoxy fluoro-polymer.

6. A dry developer composition in accordance with claim 5 wherein the styrene is present in an amount of 40 percent by weight, the n-butylmethacrylate is present in an amount of 58 percent by weight, and the vinyl benzyl trimethylammonium chloride is present in an amount of 2 percent by weight.

7. A method for developing images in an electrophotographic imaging system which comprises forming an electrostatic latent image on a photoreceptor which has been charged negatively, contacting the image with the developing composition of claim 1 or claim 2, followed by transferring the developed image to a suitable substrate and permanently affixing the image thereto by heat.

8. A method for developing images in an electrophotographic imaging system which comprises forming an electrostatic latent image on a photoreceptor which has been charged negatively, contacting the image with the developing composition of claim 3 or claim 4 followed by transferring the developed image to a suitable substrate, and permanently affixing the image thereto by heat.

9. A method for developing images in an electrophotographic imaging system which comprises forming an electrostatic latent image on a photoreceptor which has been charged negatively, contacting the image with the developing composition of claim 5 or claim 6 followed by transferring the developed image to a suitable substrate and permanently affixing the image thereto by heat.

* * * * *